US005655800A

United States Patent [19]

DeMarco

[11] Patent Number: 5,655,800

[45] Date of Patent: Aug. 12, 1997

[54] MANUAL PIN-TYPE LOCKING ASSEMBLY FOR LOCKING THE DOOR OF A HOBBY OR CUSTOM VEHICLE

[76] Inventor: Stephen R. DeMarco, Rte. 3, Box 376-M, Clinton, N.C. 28328

[21] Appl. No.: 488,680

[22] Filed: Jun. 8, 1995

[51] Int. Cl.[6] ..... E05C 1/12

[52] U.S. Cl. ..... 292/167; 292/163; 292/177

[58] Field of Search ..... 292/216, 163, 292/164, 166–168, 177, 169, 17, 201, DIG. 49

[56] References Cited

U.S. PATENT DOCUMENTS

| | | | |
|---|---|---|---|
| 1,256,992 | 2/1918 | Edgar | 292/167 |
| 1,280,777 | 10/1918 | Linstrom | 292/167 |
| 1,394,962 | 10/1921 | Bate | 292/167 |
| 2,038,062 | 4/1936 | Simpson | 292/167 |
| 2,086,474 | 7/1937 | Gietl | 292/DIG. 49 |
| 4,445,729 | 5/1984 | Scheerhorn | 292/167 |
| 5,273,324 | 12/1993 | Kobayashi | 292/201 |
| 5,310,228 | 5/1994 | Ellenberg | 292/167 |

*Primary Examiner*—Steven N. Meyers
*Assistant Examiner*—Gary Estremsky
*Attorney, Agent, or Firm*—Rhodes, Coats & Bennett, LLP

[57] ABSTRACT

A manually actuated pin-type door locking assembly is shown. The pin-type locking assembly includes a housing having a locking pin confined within a locking cavity and movable between an unlocked position and a locked position. A rotary shaft actuator is rotatably mounted to the housing and is connected to the locking pin via a swing arm. The swing arm is spring biased. By rotating the rotary actuator shaft back and forth, the locking pin is moved between the unlocked position and a locked position where the locking pin effectively locks the door of a vehicle to an adjacent frame structure.

4 Claims, 4 Drawing Sheets

MANUAL PIN-TYPE LOCKING ASSEMBLY FOR LOCKING THE DOOR OF A HOBBY OR CUSTOM VEHICLE

FIELD OF THE INVENTION

The present invention relates to hobby and custom cars and more particularly to a manual pin-type door locking assembly for installation into such car.

BACKGROUND OF THE INVENTION

In recent years, the popularity of hobby and custom cars has continued to increase. These cars are typically constructed from kits. In many cases, these hobby or custom cars employ what is referred to as a "suicide" door that is typical of vintage car designs. A "suicide" door is a door that hinges about its rear end and basically swings open in a front to back fashion. "Suicide" doors are not without their problems and drawbacks. One of the problems associated with "suicide" doors is that they can have a tendency to pop open during travel. The tendency of the vehicle occupant is to reach out to retain the door and too often this act leads to an accident.

Therefore, there has been and continues to be a need for a relatively simple manually actuated door lock kit that can be installed into hobby and custom-type cars so as to securely lock the door to an adjacent frame structure that forms part of the vehicle.

SUMMARY AND OBJECTS OF THE INVENTION

The present invention entails a relatively simple manually actuating pin-type door locking assembly that can be manufactured and sold in a kit form to be installed into vehicle doors, particularly "suicide"-type doors commonly found in hobby cars. The pin-type door locking assembly of the present invention includes a housing structure that includes a locking pin cavity having a locking pin slideable therein and movable between an unlocked position and a locked position. A shaft is rotatably journalled within the housing and operatively connected to the locking pin through a swing arm secured to the shaft and a connecting pin that interconnects the swing arm with the locking pin. Consequently, the rotary action of the shaft results in the locking pin being moved between an unlocked position and a locked position. A spring is also employed and is connected to the swing arm so as to give rise to an overcenter-type biasing action that biases the swing arm to one of two extreme positions which makes the actuation of the locking pin relatively easy.

It is therefore an object of the present invention to provide a simple and reliable manually actuated pin-type door locking assembly that is particularly adapted to be installed into doors of hobby and custom cars.

Another object of the present invention to provide a pin-type door locking assembly of the character referred to above that is easy to install within a door and which employs a spring-type biasing member which makes the actuation of the locking pin relatively easy.

DESCRIPTION OF THE INVENTION

Figure 1:
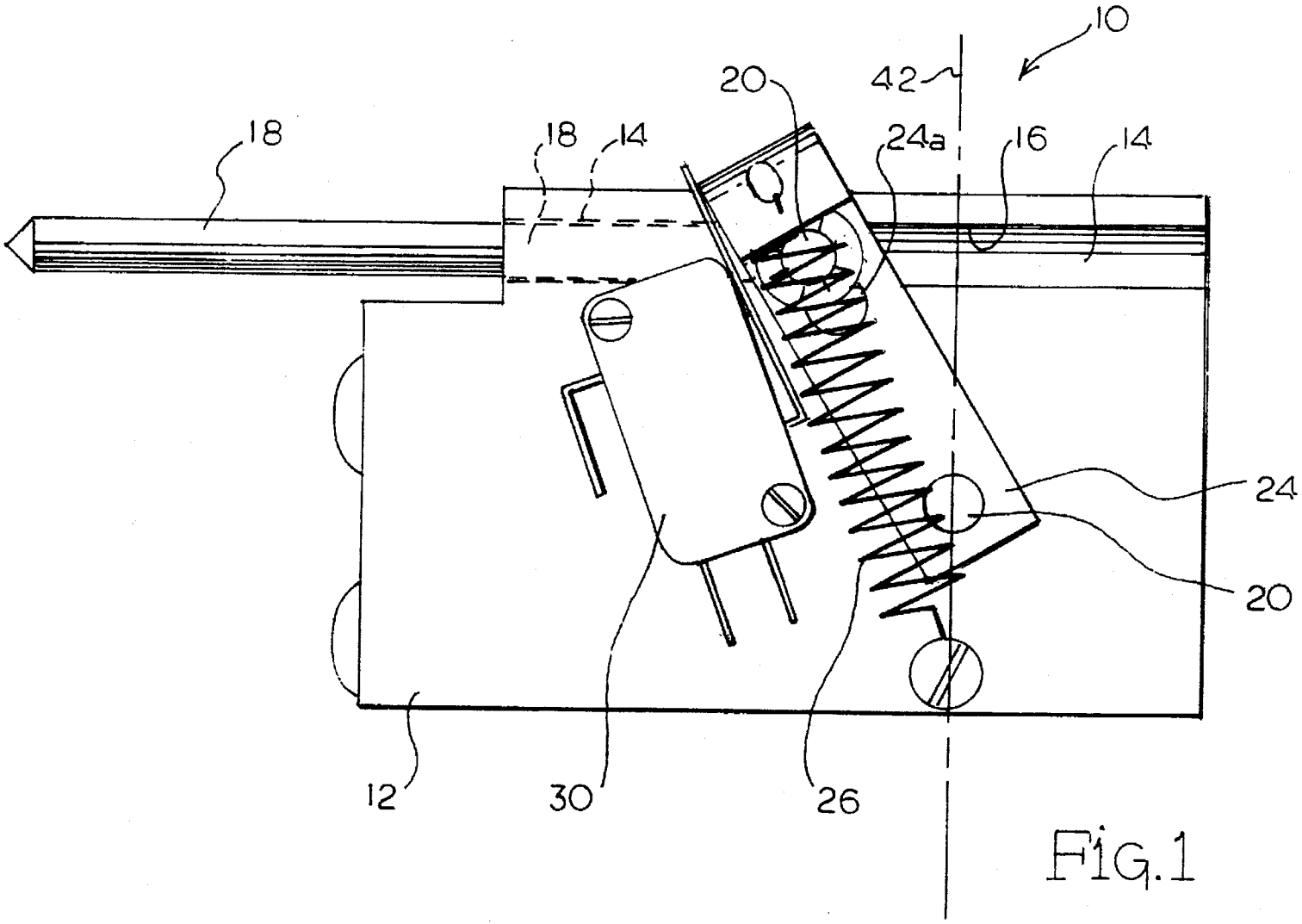
FIG. 1 is a side elevational view of the pin-type door locking assembly of the present invention with the locking pin being disposed in the extended and locked position.
Figure 2:
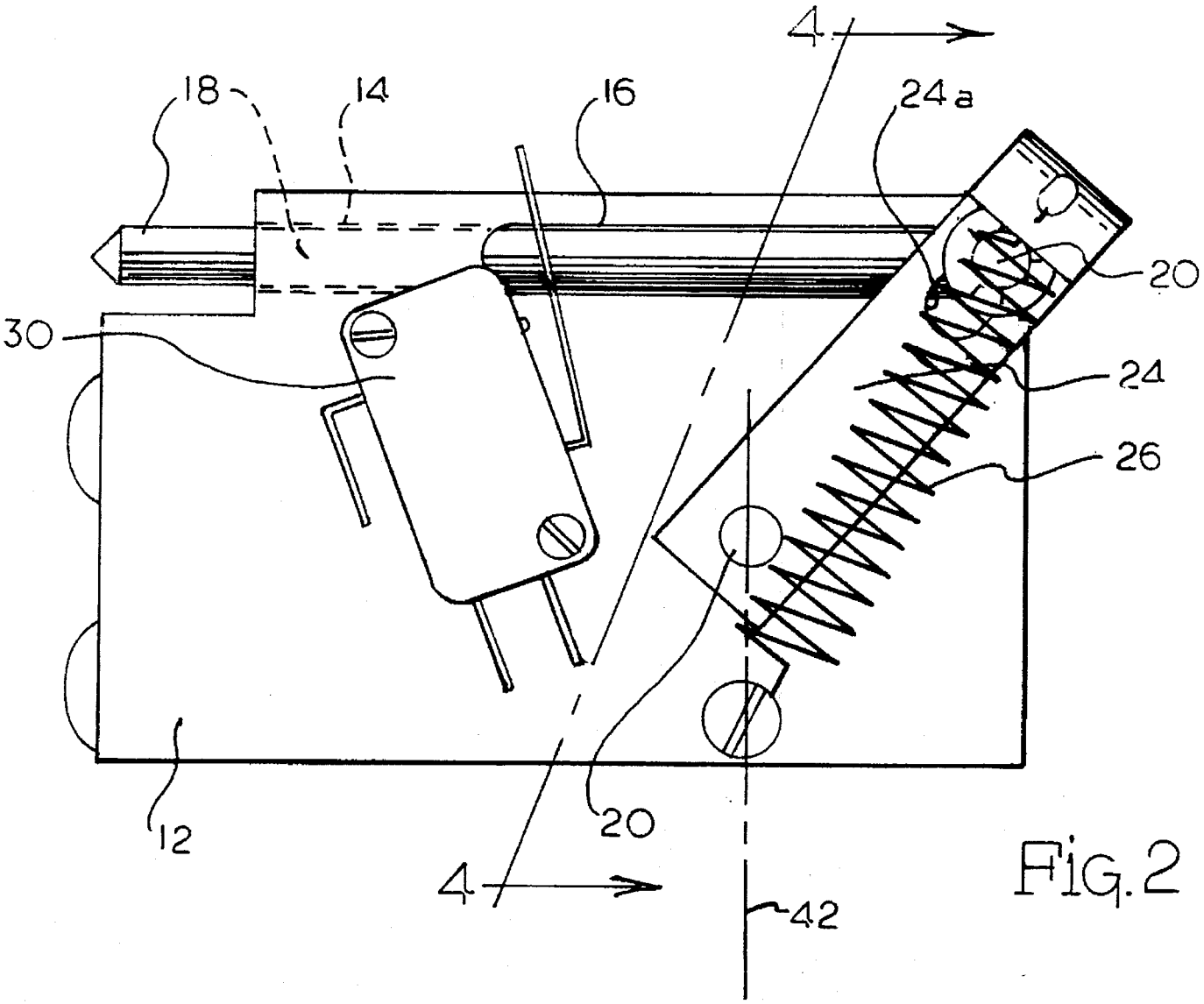
FIG. 2 is a side elevational view similar to FIG. 1 except that the locking pin is shown in the retracted or unlocked position.
Figure 3:
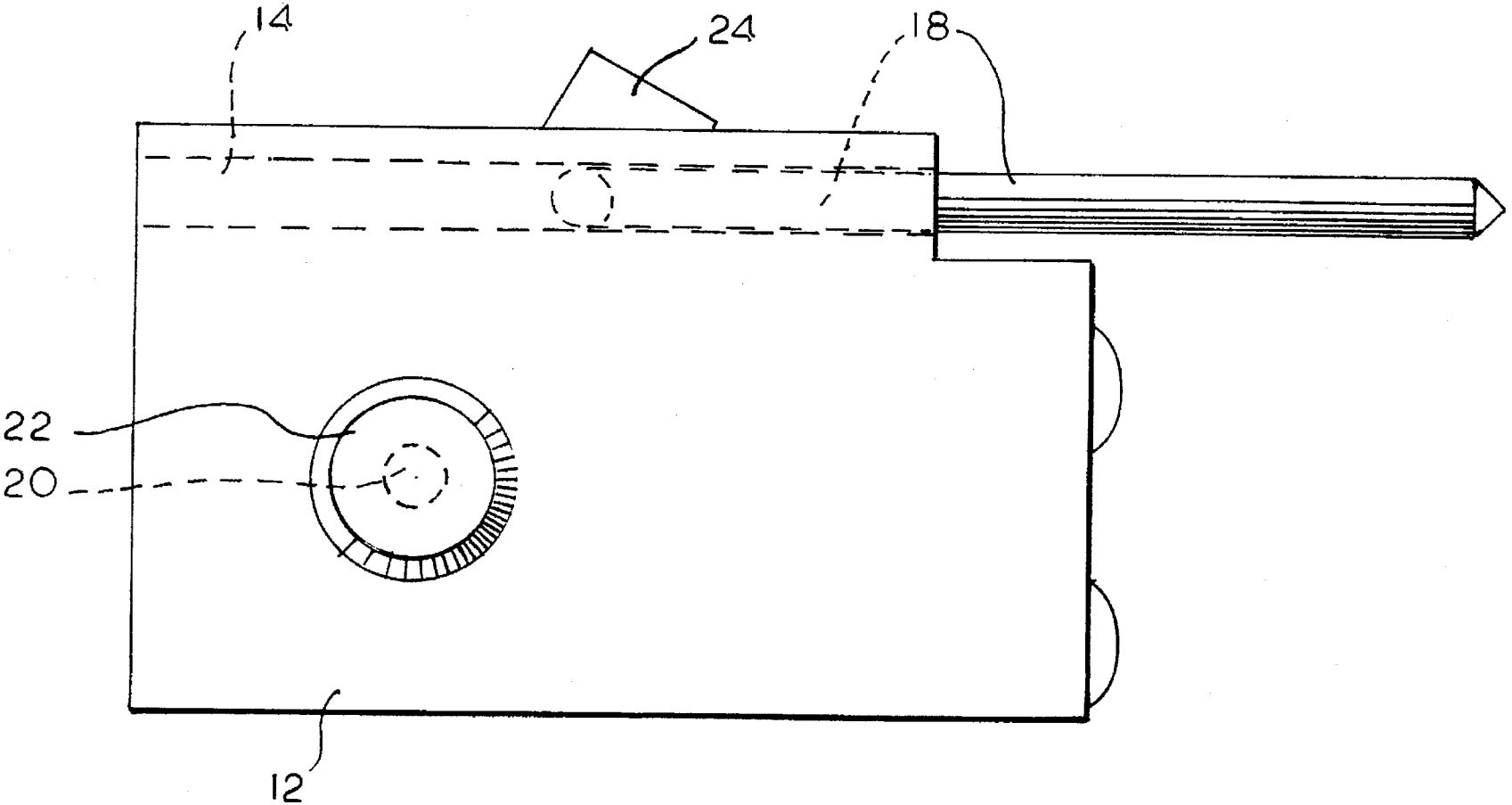
FIG. 3 is a side elevational view of the pin-type door locking assembly of the present invention showing the opposite sides of that shown in FIGS. 1 and 2.
Figure 4:
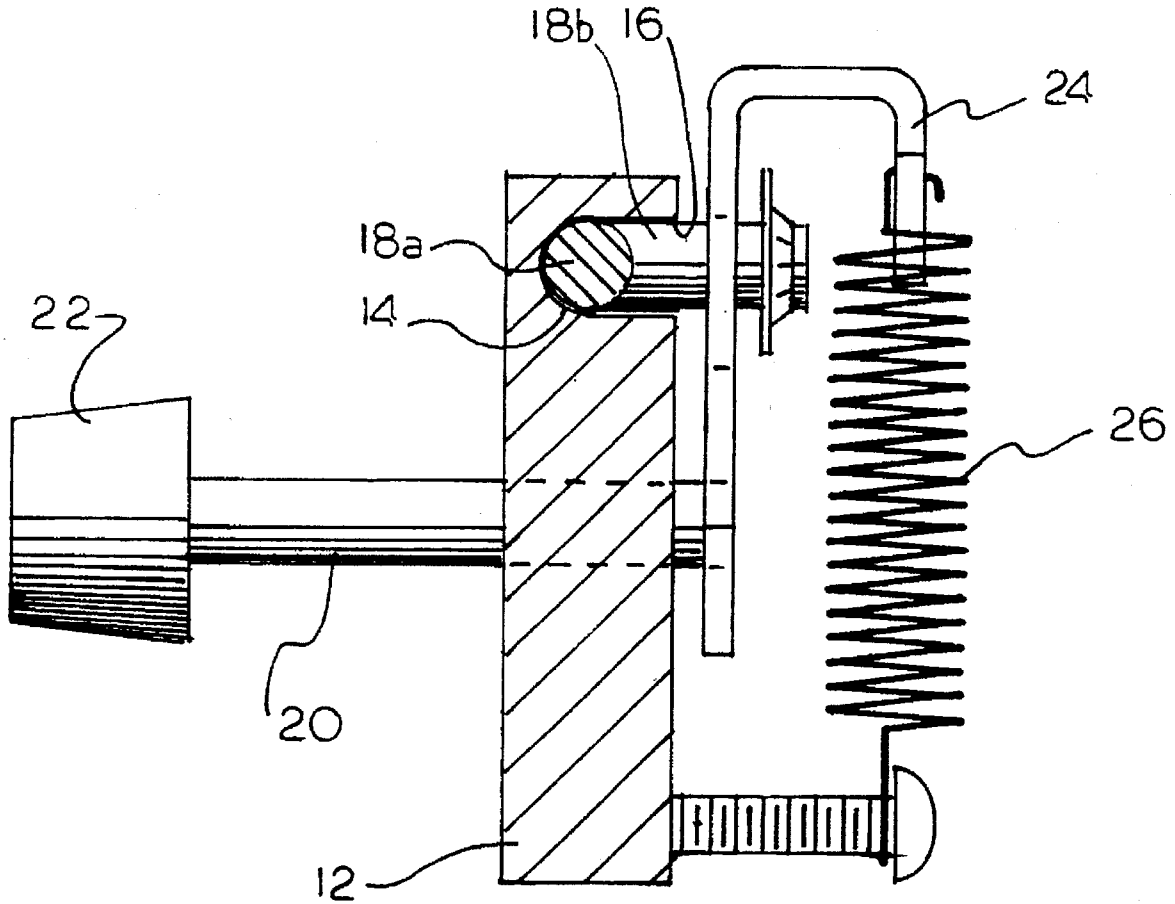
FIG. 4 is a transverse cross-sectional view taken through the lines 4—4 of FIG. 2.

With further reference to the drawings, the manual pin-type door locking assembly of the present invention is shown herein and indicated therein by the number 10. Locking assembly 10 is designed to be installed into the door or into a frame structure disposed adjacent the door of a vehicle for securely locking the door in a closed position. As will be understood from subsequent portions of this disclosure, the door locking assembly 10 is adapted to be manually actuated between an unlocked position and a locked position.

Now turning to a discussion of the locking assembly 10, it is seen same includes a housing structure 12 that is in the form of a plate or block-type housing. Housing 12 includes an elongated locking pin cavity 14 that is designed to receive a reciprocating locking pin 18 therein. It is seen that the block housing 12 includes a pair of opposed sides and there is formed a side slot 16 on one side of the housing 12. Side slot 16 is formed adjacent the locking pin cavity 14 and is such that the locking pin cavity is opened from the side through the side slot.

The locking pin 18 includes a main section **18*a* that includes an outer terminal end that forms the locking portion of the locking pin. Also locking pin 18 includes a turned-in portion 18*b* that forms a connecting pin for the manual actuating device associated with locking assembly 10. In any event, locking pin 18 is designed to reciprocate within the locking pin cavity 14** and in the process moves between an unlocked position and a locked position.

As discussed above, locking assembly 10 includes a manual actuating device for moving the locking pin 18 between the unlocked and locked positions. The manual actuating device includes a shaft or rotary actuator 20 having a knob 22 secured to an outer end thereof. Shaft 22 extends transversally through the housing 12 and about the end thereof opposite the knob 22 there is provided a swing arm 24 that is secured to the shaft 20 and rotatable back and forth therewith. Arm 24 includes an elongated slot **24*a*. The connecting pin 18*b* extends from the locking pin cavity 14 through the side slot 18 and is confined within slot 24*a* of arm 24. Thus, it is appreciated that as arm 24 swings back and forth that the connecting pin 18*b* confined with side slot 24*a* causes the locking pin 18** to be moved back and forth between the locked and unlocked positions.

The manual actuating device is spring biased towards both the locked and unlocked positions. This is achieved by spring 26 that is anchored to a point on the housing 12 and is connected to a top portion of the arm 24. Spring 26 is specifically oriented such that it acts as an "overcenter" latching mechanism. That is, spring 26 is positioned with respect to the arm 24 such that the spring biases the arm 24 to two extreme positions which correspond to the unlocked and locked positions of the locking pin 18. As the arm 24 moves from the unlocked position towards a locked position, it is appreciated that once the center line of the spring 26 passes a center reference line 42 that the spring effectively biases the arm 24 towards the other extreme position.

Mounted on the side of the housing 12 adjacent the swing arm 24 is a microswitch 30 that is connected to an indicator or signaling device (not shown). The microswitch 30 is placed adjacent the arm such that the back and forth swinging movement of the arm 24 is operative to actuate the microswitch 30 between "on" and "off" positions. Thus, the microswitch 30 is operative to indicate to a person whether the locking assembly 10 is in the unlocked position or the locked position.

Finally, in operation, the locking assembly 10 is designed such that in the locked position the locking pin 18 extends from the locking pin cavity 14 and the housing 12 and inserts into a locking opening formed in an adjacent structure. As pointed out above, the locking assembly 10 can be installed in the door of the vehicle or in a structure adjacent the door.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed:

1. A manual pin-type locking assembly for a vehicle door comprising:

a) a housing;

b) an elongated locking pin cavity formed within the housing with the locking pin cavity having opposed ends and wherein at least one end is open;

c) a locking pin movably mounted within the locking pin cavity and movable therein between a disengaged position and a locked position wherein in the locked position the locking pin extends out the open end of the elongated locking pin cavity;

d) an actuating shaft rotatably mounted transversely within the housing with the actuating shaft extending completely through the housing;

e) a swing arm fixed to the actuating shaft on an exterior side of the housing and extending from the actuating shaft along one side of the housing and wherein the swing arm can be moved back and forth by manually turning the rotating shaft;

f) a slot formed in said exterior side of the housing adjacent the elongated locking pin cavity such that the cavity is open on the side of the housing adjacent the swing arm;

g) a second slot formed in the swing arm adjacent the slot formed in the side of the housing;

h) a connecting pin secured to the locking pin and extending outwardly therefrom through the slot in the side of the housing and into and through the slot formed within the swing arm such that as the swing arm is moved back and forth the connecting pin is operative to drive the locking pin back and forth within the locking pin cavity between the disengaged position and the locked position; and i) a spring secured to the side of the housing adjacent the swing arm with the spring being anchored at one point and connected to a point on the swing arm spaced from the swing arm's connection to the rotating shaft and wherein the spring is particularly oriented with respect to the swing arm such that the spring biases the swing arm towards extreme positions with respect to a center reference line.

2. The manual pin-type locking assembly of claim 1 wherein there is provided a microswitch mounted to the side of the housing adjacent the swing arm and wherein the microswitch is aligned with the swing arm such that the swing arm is operative to actuate the microswitch.

3. The manual pin-type locking assembly of claim 2 wherein the locking pin and the connecting pin together are of an integral construction and wherein the connecting pin is formed by simply turning an end portion of the locking pin.

4. The manual pin-type locking assembly of claim 3 wherein the swing arm includes a generally u-shaped end opposite the end that connects to the actuating shaft and wherein the u-shaped end of the swing arm is attached to one end of the spring.

* * * * *